United States Patent [19]

Gugliotti

[11] 4,426,567

[45] Jan. 17, 1984

[54] ELECTRIC HAIR CURLING IRON

[75] Inventor: Carmelo I. Gugliotti, Buenos Aires, Argentina

[73] Assignee: Andrew Turrissi, Hartford, Conn.

[21] Appl. No.: 294,491

[22] Filed: Aug. 20, 1981

Related U.S. Application Data

[63] Continuation of Ser. No. 49,282, Jun. 18, 1979, abandoned.

[51] Int. Cl.[3] ..... A45D 1/02; H05B 3/02

[52] U.S. Cl. ..... 219/225; 132/9; 132/31 R; 132/32 R; 132/37 R; 132/38 R; 132/41 R; 132/118; 219/230; 219/243

[58] Field of Search ..... 219/222-226, 219/230, 243; 132/31 R, 32 R, 37 R, 37 A, 38 R, 41 R, 48 R, 117, 118, 11 R

[56] References Cited

U.S. PATENT DOCUMENTS

| | | | |
|---|---|---|---|
| 1,465,838 | 8/1923 | Caneavri | 132/32 R |
| 1,580,370 | 4/1926 | Domdamville et al. | 132/32 R |
| 1,583,728 | 5/1926 | Markle | 132/31 R |
| 1,593,055 | 7/1926 | Arnole | 132/31 R |
| 1,607,076 | 11/1926 | Hamilton | 132/41 R |
| 1,642,251 | 9/1927 | Langdon | 132/32 R |
| 1,693,462 | 11/1928 | Polnaszek | 132/37 R |
| 1,781,812 | 11/1930 | Goodman et al. | 132/38 R |
| 1,937,004 | 11/1933 | Anderson | 132/118 |
| 3,805,811 | 4/1974 | Dorn | 132/37 R |
| 3,955,064 | 5/1976 | Demetrio et al. | 219/225 |

FOREIGN PATENT DOCUMENTS

| | | | |
|---|---|---|---|
| 53-68383 | 6/1978 | Japan | 219/225 |

*Primary Examiner*—A. Bartis

*Attorney, Agent, or Firm*—Robert S. Smith

[57] ABSTRACT

An electric hair curling iron for producing curls of exotic shape includes elongated member of square transverse cross section incorporating an electric heating element and defining a hair engaging mandrel. The mandrel is provided at one end with a manipulating handle. A elongated spring-biased hair clamping member is pivotally mounted on the handle end of the mandrel and arranged for movement toward and away from the mandrel. The hair clamping member defines an elongated channel of U-shaped cross section having a first planar surface with second and third planar surfaces orthogonal thereto and disposed in such mutually spaced relationship as to provide a snug interfitting engagement with the mandrel when brought into clamping relationship therewith. The first, second and third planar surfaces of the clamping member are coextensive in length and the second and third surfaces have a width approximately one half of the width of a side of the mandrel. The handle is provided with a fluid reservoir from which a quantity of liquid can be forced into the interior of the mandrel so that moisture can be ejected onto the hair being curled through holes along the length of the mandrel.

3 Claims, 4 Drawing Figures

Fig. 1
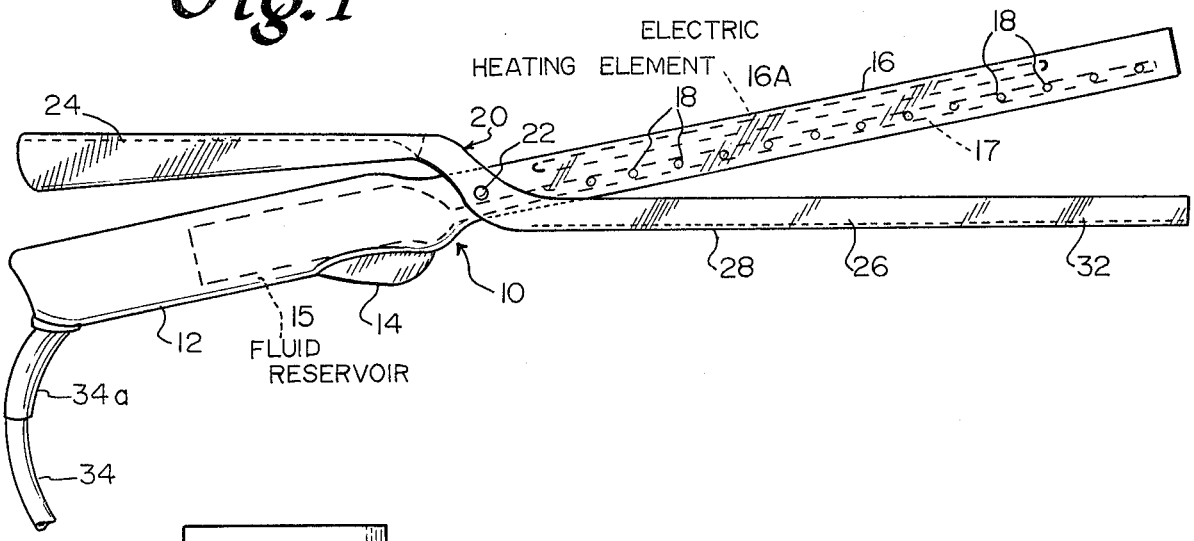
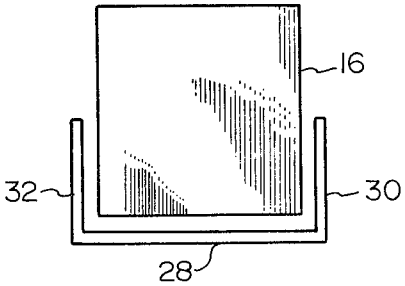
Fig. 2
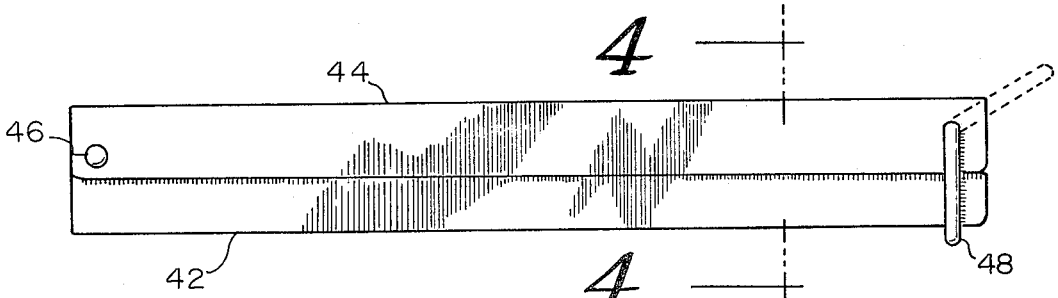
Fig. 3
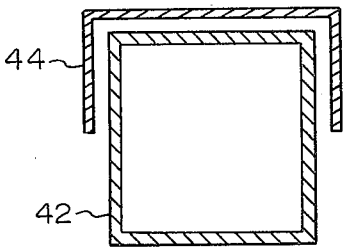
Fig. 4

ELECTRIC HAIR CURLING IRON

This is a continuation, of application Ser. No. 049,282, filed June 18, 1979 now abandoned.

BACKGROUND OF THE INVENTION

The invention relates to grooming devices and particularly to hair curling devices. The invention has special application to electric curling irons although it will be understood to have applications to so called curlers which have no integral source of heat. The prior art curling irons have traditionally been cylindrical tubes with arcuate cross section cooperating members. Such devices produce conventional waves and curls having a generally arcuate contour.

The desire for more exotic hair styles is well known. Women, for example, have often braided their hair in order to produce a very fine kinked pattern after the hair is unbraided. This process is extremely time consuming. The present invention has been found to rapidly produce a curl having a highly novel appearance.

It is an object of the invention to provide apparatus which will rapidly produce a highly novel curl having an aesthetically appealing appearance.

It is another object of the invention to provide apparatus which will produce such curls and which will be inexpensive to manufacture and easy to use.

SUMMARY OF THE INVENTION

In accordance with one form of the invention a curling iron comprises a first elongated member including a handle disposed at one end and a heater portion disposed at the other or second end. The heater portion has a cross section which is generally rectangular. A second elongated member has an elongated channel piece at one end portion which includes a first planar surface and second and third planar surfaces each disposed orthogonally in relationship to the first planar surface, the second and third planar surfaces are disposed in spaced relationship with a dimension therebetween which provides a snug engagement between at least an axial portion of the elongated channel and the heater portion with the elongated channel disposed about at least part of the extent of three successive sides of said heater portion. Pivot means engage said first and second members to allow pivotal motion therebetween for engaging and disengaging the elongated channel and heater portion.

The invention preferably includes a handle disposed at one end of the second member remote from the elongated channel to provide maximum operator control. In other forms the second member may be biased by a spring against the heater portion. The heater portion will have a cross section which is square. The heater portion may further include holes disposed in said heater at axially spaced intervals and the handle of the first member may be provided with a fluid reservoir in communication with the holes together with means for forcing an associated fluid out of the reservoir and through the holes.

In another form of the invention a curler includes a first elongated generally rectangular cross section member; a second elongated channel shaped member having a first planar surface and second and third planar surfaces which are disposed in orthogonal relationship to the first planar surface. The second and third planar surfaces are spaced to provide a snug fitting relationship when at least an axial portion of the first member is disposed in nested relationship with the second member and means for holding the first and second members in nested relationship. Preferably the first member has a square cross section over at least an axially portion thereof.

BRIEF DESCRIPTION OF THE DRAWING

FIG. 1 is a partially schematic side elevational view of a curling iron embodying the present invention;

FIG. 2 is a partial front elevational view of the same curling iron with axial portions of the members thereof disposed in nested relationship;

FIG. 3 is a side elevational view of a curler in accordance with another form of the present invention;

FIG. 4 is a sectional view of the curler taken through the plane 4—4 of FIG. 3.

DETAILED DESCRIPTION OF THE PREFERRED EMBODIMENT

Turning now in detail to FIGS. 1 and 2 of the attached drawing there is illustrated a curling iron in accordance with one form of the invention. A first member 10 is elongated and has a handle 12 at one end portion thereof. A reservoir 15 for fluid and a push button 14 for ejecting that fluid are disposed in the handle. The other end portion of the first member 10 forms generally rectangular or square cross-section heater portion 16 having integral therewith an electric heating element 16A shown schematically in FIG. 1. The heater portion 16 is preferably square since this presents a decided advantage in using the apparatus. More particularly when the heater portion 16 is constructed with a square cross section the curling iron may be used to form a partial curl and then may be rotated or indexed about the axis thereof 90° to further form a curl which extends for 360°. It is understood that holes 18 may be provided in the heater portion 16. The holes may be disposed in fluid communication with the reservoir 15. Pushbutton 14 is operable to selectively eject fluid from the reservoir 15 via conduit 17 and holes 18 onto the hair which is being heated and curled. Preferably the holes 18 will be disposed on at least two sides of the heater portion 16.

Cooperating with the first member 10 is a second member 20 connected thereto by pivot 22 to allow a pivoting motion with respect to the first member. The second member 20 has a handle 24 at one end and a channel shaped member 26 at the other end thereof. The channel shaped member is dimensioned and configured for snug engagement with the heater 16. More particularly, the channel shaped member 26 has a first planar surface 28 and second and third planar surfaces 30 and 32 disposed in perpendicular relationship to the first planar surface 28. The snug engagement which is preferred exists where the spacing between heater portion 16 and member 26 is just sufficient to allow a number of strands of hair disposed initially in generally parallel coplanar relationship to fit therebetween. In a preferred form of the invention each side of the heater portion 16 has a square cross section which is 11/16 of an inch on each side. The second and third planar surfaces extend 5/16 of an inch along the side of the heater portion 16 with which they cooperate. The channel shaped member 26 is approximately 1/32 of an inch thick and is preferably made of aluminum or other metal. The heater portion 16 includes a conventional resistance heating element (not separately shown which receives electric current through an electic power cord 34. The power cord 34 preferably includes a swivel section 34a. The exterior of the heater portion 16 is preferably metal, however, it has been found that some plastic and some metals will also function satisfactorily.

In operation the operator grasps the handles 12 and 24 and positions hair intermediate the heater portion 16 and the channel shaped member 26 to form a partial curl. In a preferred manner of use the hair which is initially formed is held stationary while the curling iron is rotated 90° about its axis so that the curl initially formed is further formed into a generally rectangular curl. This curl may sometimes be referred to by the unregistered trademark "QUADRO CURL". This trademark is owned by the assignee of this application.

Referring now to FIGS. 3 and 4 there is shown another embodiment of the invention which utilize curlers without an integral source of heat. Each curler includes a first member 42 which has a generally rectangular cross section and a second generally channeled shaped member 44 with a first planar surface and perpendicular second and third surfaces. These first and second members 42 and 44 correspond respectively to heater member 16 and member 26 in the embodiment shown in FIG. 1. A pivot 46 is provided between the members 42 and 44. A clamp 48 is provided to lock the curlers in cooperating relationship. It will be understood that curlers are used in the conventional manner for curlers and that the means for holding the curler in nested relationship to form a curl are conventional. The geometry of the curler is of course novel.

Having thus described my invention I claim:

1. A curling iron which comprises:

a first elongated member which includes a handle at one end portion thereof and a heating element disposed at the second end portion thereof, said second end portion being elongated and having a square transverse cross-section;

a second elongated member having an elongated channel at one end portion thereof, said elongated channel including a first planar surface, and second and third planar surfaces each disposed in orthogonal relationship to said first planar surface, said second and third planar surfaces being disposed in mutually spaced relationship with a dimension therebetween which provides a snug interfitting engagement between at least an axial portion of said elongated channel and said second end portion of said first elongated member;

said first, second and third planar surfaces of said channel being substantially coextensive in length, said second and third planar surfaces having a width approximately one half of the width of a side of said second end portion of said first elongated member; and pivot means connecting said first and second members to allow relative pivotal motion therebetween for engaging and disengaging said elongated channel and said second end portion of said first elongated member.

2. The apparatus as described in claim 1, wherein:

said second member further includes a handle disposed at the end portion thereof remote from said elongated channel.

3. The apparatus as described in claim 1, wherein:

said second end portion of said first elongated member further includes holes disposed at axially spaced intervals, a reservoir on said first member in fluid communication with said holes, and means on said first member for selectively forcing an associated fluid out of said reservoir and through said holes.

* * * * *